US006817131B1

(12) United States Patent
Prechtl

(10) Patent No.: US 6,817,131 B1
(45) Date of Patent: Nov. 16, 2004

(54) SAFETY DEVICE FOR FIREARMS WITH A FIRING PIN LOCK

(76) Inventor: Gottfried Prechtl, 69469 Weinheim, Weinheim (DE)

( * ) Notice: Subject to any disclaimer, the term of this patent is extended or adjusted under 35 U.S.C. 154(b) by 0 days.

(21) Appl. No.: 10/420,822

(22) Filed: Apr. 23, 2003

(30) Foreign Application Priority Data

Mar. 18, 2002 (DE) ..... 102 11 882

(51) Int. Cl.[7] ..... F41A 17/64

(52) U.S. Cl. ..... 42/70.08; 42/70.01; 42/7.04; 42/70.05; 42/70.06; 42/70.11

(58) Field of Search ..... 42/70.08, 70.01, 42/70.11, 70.04, 70.05, 70.06

(56) References Cited

U.S. PATENT DOCUMENTS

| | | | | | |
|---|---|---|---|---|---|
| 3,159,080 | A | * | 12/1964 | Freed | 89/148 |
| 3,750,531 | A | * | 8/1973 | Angell et al. | 89/148 |
| 3,830,002 | A | * | 8/1974 | Volkmar | 42/70.08 |
| 3,942,278 | A | * | 3/1976 | Schaller et al. | 42/70.08 |
| 4,021,955 | A | * | 5/1977 | Curtis | 42/70.08 |
| 4,352,317 | A | * | 10/1982 | Wilhelm | 89/154 |
| 4,555,861 | A | * | 12/1985 | Khoury | 42/69.01 |
| 4,726,136 | A | * | 2/1988 | Dornaus et al. | 42/70.08 |
| 4,768,302 | A | * | 9/1988 | Beretta | 42/70.08 |
| 4,769,936 | A | * | 9/1988 | Miller | 42/66 |
| 5,245,776 | A | * | 9/1993 | Dornaus | 42/70.08 |
| 5,259,138 | A | * | 11/1993 | Scirica | 42/70.08 |
| 5,267,407 | A | * | 12/1993 | Bornancini | 42/70.08 |
| 5,635,663 | A | * | 6/1997 | Krieger et al. | 89/142 |
| 5,666,754 | A | * | 9/1997 | de Oliveira Masina | 42/70.08 |
| 6,141,896 | A | * | 11/2000 | Oberst | 42/70.06 |
| 6,173,518 | B1 | * | 1/2001 | Oberst | 42/70.06 |
| 6,347,526 | B1 | * | 2/2002 | Ledbetter | 62/237 |
| 6,347,538 | B1 | * | 2/2002 | Doiron | 70/58 |
| 6,523,294 | B2 | * | 2/2003 | Curry et al. | 42/66 |

FOREIGN PATENT DOCUMENTS

| | | | |
|---|---|---|---|
| DE | 0678894 | * | 7/1939 |
| DE | 19958337 C1 | * | 3/2001 |
| GB | 460859 | * | 7/1935 |
| WO | WO/99/05467 | * | 2/1999 |

* cited by examiner

*Primary Examiner*—Jack Keith
*Assistant Examiner*—John Richardson
(74) *Attorney, Agent, or Firm*—Milbank, Tweed, Hadley & McCloy LLP

(57) ABSTRACT

The invention relates to a safety device for firearms with a firing pin lock to prevent the unintended unlocking of the firearm. The safety device comprises a rotatable safety shaft connected to the firing pin lock with locking surfaces. The safety shaft is adjustable in at least two positions for locking at least the firing pin. The safety shaft, while securing the weapon, is fixed in such a way that any force applied to the safety wing cannot result in movement of either the safety wing or the safety shaft.

26 Claims, 3 Drawing Sheets

Sectional View: Released Position

Sectional View: Secured Position

Sectional View: Released Position

SAFETY DEVICE FOR FIREARMS WITH A FIRING PIN LOCK

FIELD OF INVENTION

This invention relates to a safety device for firearms with a firing pin lock to prevent the unintended unlocking of the firearm wherein the safety device comprises a rotatable safety shaft connected to the firing pin lock with locking surfaces. The safety shaft is adjustable in at least two positions for locking of at least the firing pin.

BACKGROUND OF INVENTION

Hunting rifles and other firearms are commonly equipped with safety devices, which prevent unintended unlocking of the firearm. These safety devices secure the trigger so that it cannot be actuated. A safety device where the trigger is secured, is described in DE 78 449. Other safety devices function by securing the firing pins.

Safety devices where both the trigger as well as the firing pin or bolt are secured are also known—the art. An example of such a safety device is described in EP 0 143 625 B1. A safety shaft, which is affixed at the firing pin lock, can be set to three positions. The adjustment is usually done with the thumb via a safety wing connected to the safety shaft. The safety shaft has three depressions for the positions, into which a holding pin is pushed by force of a spring. While the weapon is secured, the safety wing points towards the back and is approximately parallel to the weapons barrel. The safety shaft is then partly engaged in a slot in the firing pin lock and thereby arrests the firing pin. At the same time the lower part of the safety shaft rests on the trigger thereby arresting it as well. Finally a pin, which runs parallel to the firing pin lock and which is under the pressure of a spring, is pushed forward into a bore, thereby preventing the lock from turning. The lever for the lock is arrested as well. Through a forward movement of the safety wing by 70°, the pin is released and pulled out of the bore by force of the spring. The lock can then be turned and the weapon loaded or unloaded. A shot however cannot be fired, since the lower part of the safety shaft has not unlocked the trigger. Only when the safety wing is pushed forward into the next position, thereby unlocking the trigger, will the safety be released and the weapon free to fire. Several safety devices following this basic principle are commercially available and are generally reliable.

These safety devices, however, suffer from the disadvantage that the safety wing can be unintentionally pushed forward from the secure position, especially while climbing an elevated blind, and when the weapon is jarred or bumped during normal use when hunting. Since for the release of the safety using such a safety device requires only that the safety wing pass an angle of rotation less than 180°, the inadvertent release of the safety during normal use of the weapon cannot be excluded.

The present invention solves this problem by providing a device that prevents the safety wing from being unintentionally moved from the secure position.

SUMMARY OF INVENTION

The present invention provides a device wherein the safety shaft is arrested in a position in that secures the weapon. The safety shaft, while securing the weapon, is fixed in such a way that any force applied to the safety wing cannot result in a movement of either the safety wing or the safety shaft.

In a preferred embodiment, the safety shaft can be fixed at a firing pin lock by a flattening in the middle part of the safety shaft which can be set into the bore for the firing pin or abuts a nut at the rear of the firing pin, and therefore results in a locking of the firing pin. Such a lock can preferably have a lock bar perpendicular to the safety shaft, which when the weapon is secured can be pushed with the end that is directed towards the safety shaft into the existing space of the flat portion of the safety shaft and with its front side edge resting on the flat portion and locks the safety shaft.

The lock bar pivots around a retaining pin which is located approximately in the middle of the lock bar. It swivels into the securing position by force of a spring. It is pushed with its front side end in the direction of the safety shaft or the flattening of the safety shaft. The lock bar may be swiveled out of the secure position, thereby releasing the weapon, by applying finger pressure on the reverse side of the lock bar, while simultaneously turning the safety shaft through the safety wing.

A coil spring is preferably used and inserted into a dead end bore on the reverse side of the lock bar. To assist the moveability of the lock bar while swiveling, the lock bar is wedge shaped at least at the side opposite the safety shaft.

A completely immobile alignment of the lock bar in its longitudinal direction is accomplished by inserting the lock bar into a slot—shaped like the lock bar—wherein the slot is located alongside the firing pin lock. This slot confines the lock bar so that even shearing the hinge pin on the wing will not bring the wing out of the secure or securing-position. The slot is mounted from an axial view of the weapon in front of the safety shaft and partly uncovers the bore for the safety shaft. Therefore, the safety shaft, and especially the herein existing flattening for the lock bar, is accessible. The mounting of the lock bar in this configuration is very advantageous, if the lock bar is affixed perpendicular to or at the firing pin lock. In this configuration, the safety wing and lock bar are then ergonomically situated towards each other. The lock bar is swiveled out with pressure of the index finger or the middle finger while at the same time the safety wing is pushed forward with the thumb. To release the weapon it is necessary to unlock the firing pin lock by pressure from the side and then by pressure from behind in the direction of firing. The simultaneous application of pressure in two different directions greatly reduces or eliminates the possibility of an unintentional discharge of the weapon. Finally, the matching fitting of the lock bar prevents a shearing of the retaining pin—even under extreme forces—at the safety wing.

Embodiments of the present invention will now be described further, by way of example, with reference to the accompanying drawings.

DETAILED DESCRIPTION OF INVENTION

The invention is being described further, by example of the widespread firing pin lock type "Dakota". The arresting of the safety shaft here is easily achieved. Notably, this invention can be implemented or other locks of similar design, since a particular advantage of the present invention is that it can be fitted to already existing locks.

Figure 1:
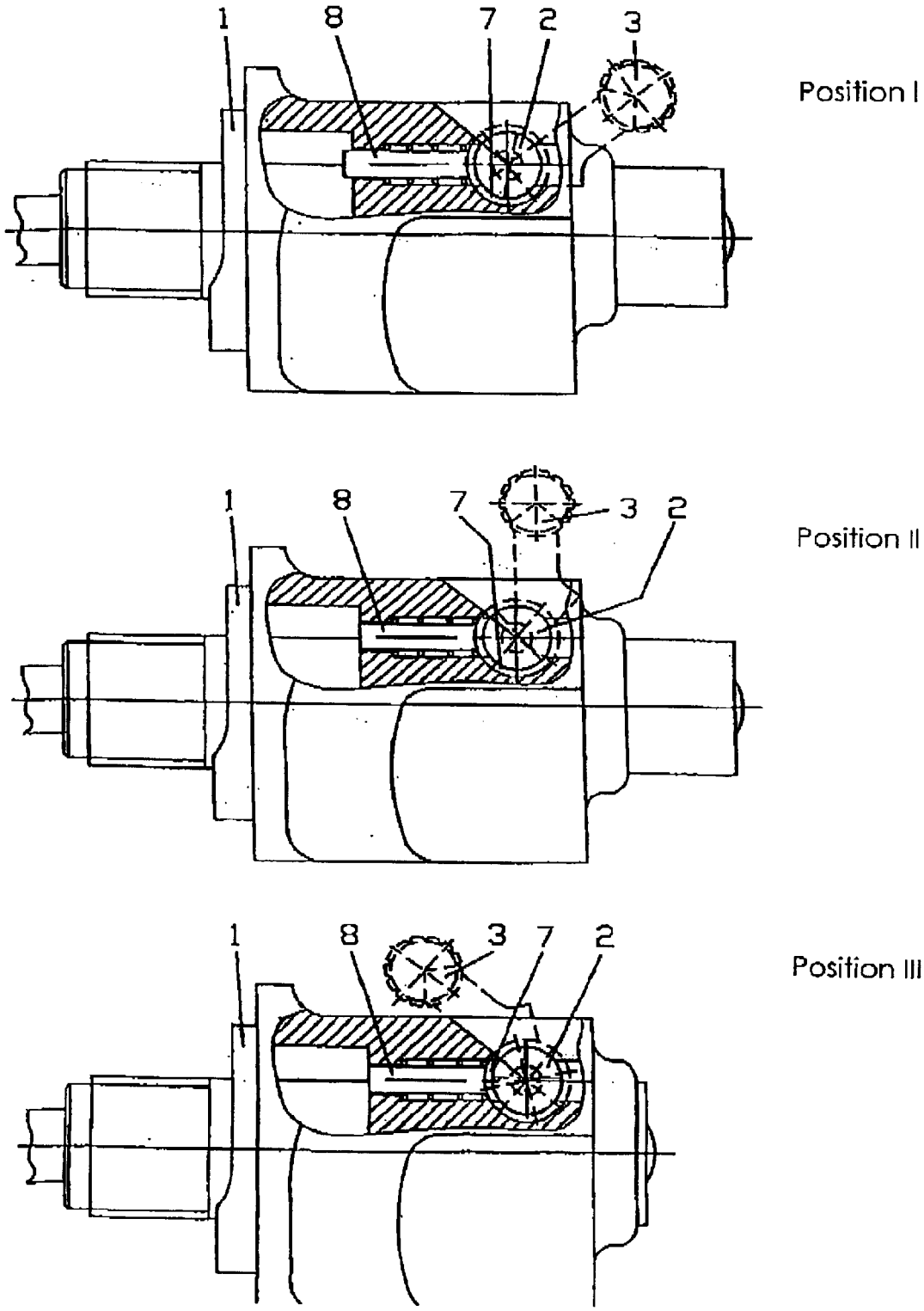
Figure 1 (Prior Art)
FIG. 1 depicts a top view of a conventional firing pin lock with safety shaft, and a partial sectional view of the turn-secure-pin for the lock in different positions.

The firing pin lock 1 in FIG. 1 in top view is provided with a safety shaft 2. The safety shaft 2 is situated it in the lock 1 and is turned by means of the safety wing 3 affixed to it. In the shown position I of the safety wing 3, the weapon is completely secured. The safety shaft 2 is swiveled into the firing pin bore 4 (FIG. 2) and abuts a nut at the rear of the firing pin 5. Thereby the firing pin 6 is blocked. At the same time the pin 8 is pushed forward through the cam area 7 into a dead end bore existing close by the socket, which is not shown in detail, and the lock 1 is thereby secured against turning. The position of the pin 8 is shown in a partial sectional view of the lock 1. In Position I, a loaded weapon may be transported and carried. The pin 8 is compulsorily pushed forward and thereby prevents an unintentional opening of the closure chamber while the mother of the firing pin is secured against flicking by the safety lever 3. In this position a large amount of the safety shaft 8 is pushed in front of the nut 5 of the firing pin.

Since the largest danger for an autonomous "Pushing-Forward" of the safety wing 3 exists when during transport of the weapon, especially during rough action such as bumping, falling or dropping, this secure or securing position is secured once more against unintentional releasing by the lock bar 10. Even a hard hit against the bar 3, which could cause a shearing of the hinge shaft, presents no danger, since the tight fit of the lock bar 10 in the flute would not allow for such a deformation of the hinge pin 12 that would allow a shearing. Instead, the safety wing 3 would break off before the shaft would being release.

The position of the lock bar 10 was chosen so that the direction of operation for conscious unlocking is opposite by 90° to the direction of releasing. An unintentional operation of the lock bar 10 in conjunction with the safety wing 3 is ergonomically eliminated. In Position II, the safety wing 3 is swiveled forward into its second position. The pin 8 is pulled inward through the spring gripping it and the securing against turning the lock 1 is suspended. The safety shaft 2 still abuts to the nut of the firing pin 5 and therefore the firing pin 6 is still blocked. Thus, Position II is still secured. The safeguard for carrying in this position is already suspended. Suspended as well is the safeguard for opening the pin 8. This securing position is used when the shooter is shortly before firing. Also this position is needed for unloading the weapon. Ammunition that might still be in the muzzle can be removed from the muzzle by opening the catch under a secured condition. Also this position is used when the lock is dismantled.

Position III shows the safety wing 3 when swiveled forward completely. In this position of the safety wing 3 the firing pin is unblocked and the weapon ready to fire. The securing Position III is the position which is necessary for firing. It unblocks the nut of the firing pin for a forward movement and allows the turning of the catch for repeating.

Figure 2:
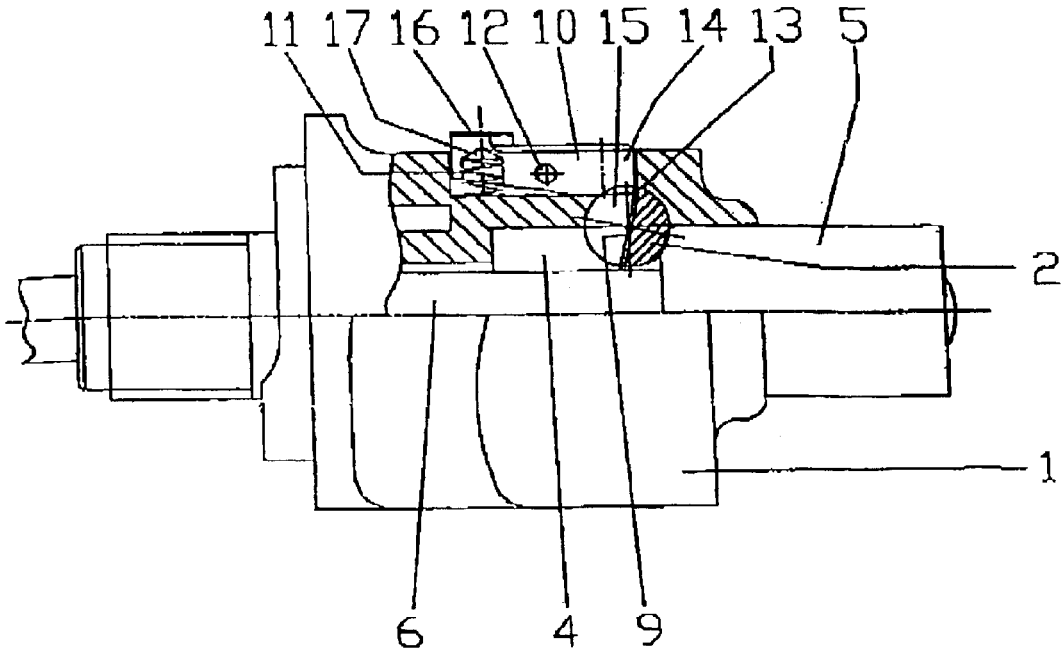
FIG. 2 depicts a top view of the firing pin, and a partial sectional view of the lock bar in the secure or securing position.

In FIG. 2 the firing pin lock 1 is also shown in a top view. The existing partial sectional view in FIG. 2 shows the horizontal middle level of the firing pin bore 4. Visible here is the existing flattening 9 in the safety shaft 2. The safety shaft 2 is swiveled into the firing pin bore 4 and abuts to the front edge of the nut of the firing pin 5. The firing pin 6 is blocked. At the same time the lock bar 10 is swiveled around the retaining pin 12 by means of the spring 11 and abuts with the front side edge 13 to the flattening 9. To accomplish this, the end 14 of the lock bar 10, which is directed towards the safety shaft 2, is swiveled into the space 15 created by the flattening of the safety shaft 2. As such, the safety shaft 2 is arrested. It can only be turned, and the weapon therefore released, when the lock bar 10 is swiveled out by pressure onto the part 16 opposite to the front edge 13 against the force of the spring by the coil spring 11 inserted into the dead end bore 17. The lock bar 10 is wedge-shaped on the part 16 opposite to the front edge 13 to aid in swiveling.

Figure 3:
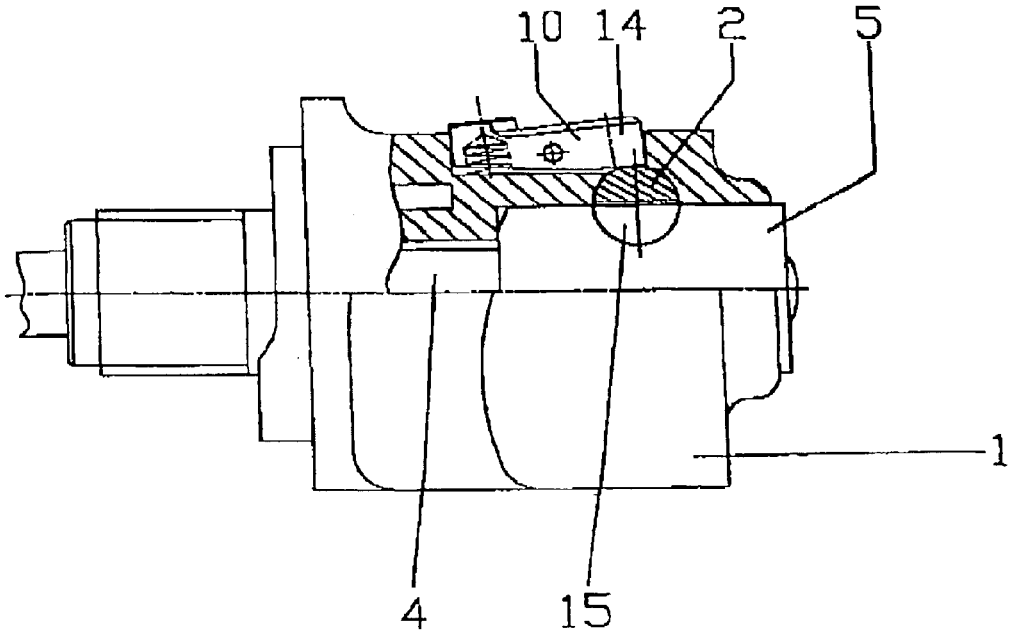
FIG. 3 depicts the view of FIG. 2 in the released position.

In FIG. 3 the position of the safety shaft 2 and the lock bar 10 is shown for a released weapon. The safety wing 3 is turned into the position pointing forward. This corresponds to Position III of the safety wing 3 in FIG. 1. The space 15 unblocks the nut of the firing pin 5. This space 15 of the safety shaft is formed in such a way that it matches the cylindrical area of the bore 4, in other words being cylindrical itself. The lock bar 10 abuts to the safety shaft 2 with the end 14 directed towards the safety shaft 2. The pin 8 shown in FIG. 1 is pulled in by the spring and the firing pin lock 1 can be turned.

Figure 4:
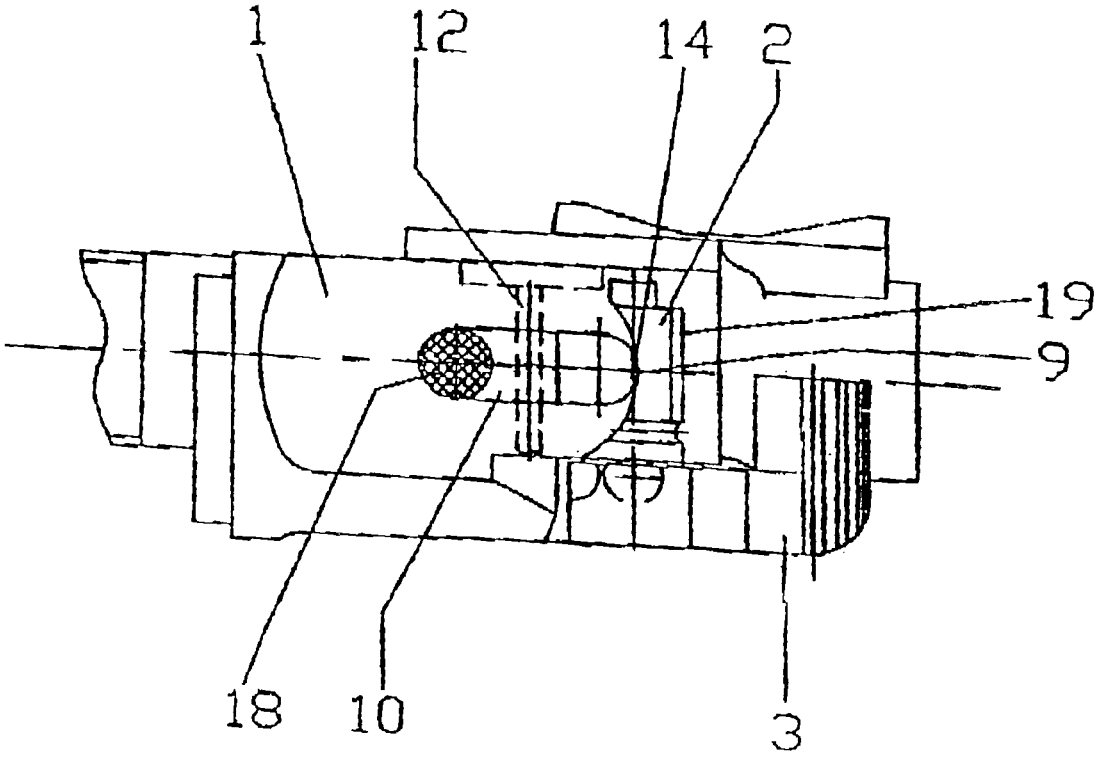
FIG. 4 depicts the firing pin lock in side view.

The firing pin lock 1 is shown in a side view in FIG. 4. Visible is the lock bar 10, that can be swiveled around the retaining pin 12 and is inserted into the slot 18. The shape of the flute coincides with the contour of the lock bar 10, so that the lock bar can almost completely disappear into the flute 18, as shown in FIGS. 2 and 3. The flute 18 is laid out in such a way that it partly uncovers the bore 19 of the safety shaft 2 perpendicular to the flute 18, so that the front side end 14 of the lock bar 10 can come in contact with the safety shaft 2 or the flattening 9 of the safety shaft 2. As mentioned above, the weapon is secured in the Position I of the safety shaft 2, as shown in FIGS. 1, 2 and 4, and the safety shaft 2 is arrested by the lock bar 10 that abuts to the flattening 9 with its front side edge 13. The pin 8 is pushed forward and secures the lock 1 against turning and possibly taking it out of the weapon. By pressure onto the part 16 of the lock bar 10, the lock bar 10 is swiveled slightly around the retaining pin 12 and the arresting of the safety shaft 2 is suspended. The safety shaft 2 can then be turned forward into Position 11 (FIG. 1). In Position 11 of the safety wing 3 and the safety shaft 2 the safeguard against turning the lock 1 by the pin 8 and the arresting of the lock bar 10 is suspended. The firing pin 6 is still secured. The lock 1 can be turned and the weapon can be loaded or unloaded, while the firing pin 6 is secured, since the safety shaft 2 still reaches into the bore 4 for the firing pin 6 and abuts to the nut of the firing pin 5. Only a complete forward turn of the safety wing 3 turns the safety shaft 2 far enough, thereby unblocking the nut of the firing pin 5, to slacken the weapon completely. In the single Positions I, II and III of the safety wing 3, it is secured by a stop bolt not specifically shown.

What is claimed is:

1. A safety device for firearms with a firing pin lock against unintended unlocking of the firearm, comprising:

rotatable and adjustable safety shaft connected to the firing pin lock with locking surfaces, wherein the safety shaft can be set in the bore for the firing pin or abuts a nut at the rear of the firing pin and locks the firing pin, and further wherein the safety shaft is flat in its middle portion and is arrestable in a locking position within the weapon; and a lock bar perpendicular to the safety shaft, wherein the lock bar, when the weapon is secured, can be pushed towards the safety shaft into the existing space at the flat portion of the safety shaft and then rests with its front side edge on the flat portion thereby locking the safety shaft.

2. The safety device according to claim 1, wherein the lock bar is pushed with its front side edge towards the safety shaft by force of a spring.

3. The safety device according to claim 1, wherein the spring is a coil spring which is inserted into a dead end bore in the part opposite to the front side edge of the lock bar.

4. The safety device according to according to claim 1, wherein the lock bar is wedge-shaped at least at the part opposite the safety shaft.

5. The safety device according to claim 1, wherein the lock bar is inserted into a slot in the shape of the lock bar alongside the firing pin lock.

6. The safety device according to claim 1, wherein the existing space is made axially within the firearm in front of the safety shaft and partly uncovers the bore for the safety shaft.

7. The safety device according to claim 1, wherein the safety shaft is disposed vertically to the firing pin lock.

8. A safely device for firearms with a firing pin lock against unintended unlocking of the firearm, comprising:

a rotatable and adjustable safety shaft connected to the firing pin lock with locking surfaces, wherein the safety shaft can be set in the bore for the firing pin or abuts a nut at the rear of the firing pin and locks the firing pin, and further wherein the safety shaft is flat in its middle portion and is arrestable in a locking position within the weapon; and a lock bar perpendicular to the safety shaft, wherein the lock bar, when the weapon is secured, can be pushed towards the safety shaft into the existing space at the flat portion of the safety shaft and then rests with its front side edge on the flat portion thereby locking the safety shaft and further wherein the lock bar tilts around a retaining pin which is located in about the middle of the lock bar.

9. The safety device according to claim 8, wherein the lock bar is pushed with its front side edge towards the safety shaft by force of a spring.

10. The safety device according to claim 8, wherein the spring is a coil spring which is inserted into a dead end bore in the part opposite to the front side edge of the lock bar.

11. The safety device according to according to claim 8, wherein the lock bar is wedge-shaped at least at the part opposite the safety shaft.

12. The safety device according to claim 8, wherein the lock bar is inserted into a slot in the shape of the lock bar alongside the firing pin lock.

13. The safety device according to claim 8, wherein the existing space is made axially within the firearm in front of the safety shaft and partly uncovers the bore for the safety shaft.

14. The safety device according to claim 8, wherein the safety shaft is disposed vertically to the firing pin lock.

15. A safety device for firearms with a firing pin lock against unintended unlocking of the firearm, comprising:

a rotatable and adjustable safety shaft connected to the firing pin lock with locking surfaces, wherein the safety shaft can be set in the bore for the firing pin or abuts a nut at the rear of the firing pin and locks the firing pin, and further wherein the safety shaft is flat in its middle portion and is arrestable in a locking position within the weapon; and a lock bar perpendicular to the safety shaft, wherein the lock bar, when the weapon is secured, can be pushed by the force of a coil spring, which is inserted into a dead end bore in the part opposite to the front side edge of the lock bar, towards the safety shaft into the existing space at the flat portion of the safety shaft and then rests with its front side edge on the flat portion thereby locking the safety shaft and further wherein the lock bar tilts around a retaining pin which is located in about the middle of the lock bar.

16. The safety device according to according to claim 15, wherein the lock bar is wedge-shaped at least at the part opposite the safety shaft.

17. The safety device according to claim 15, wherein the lock bar is inserted in a slot in the shape of the lock bar alongside the firing pin lock.

18. The safety device according to claim 15, wherein the slot is made axially within the firearm in front of the safety shaft and partly uncovers the bore for the safety shaft.

19. The safety device according to claim 15, wherein the safety shaft is disposed vertically to the firing pin lock.

20. A safety device for firearms with a firing pin lock against unintended unlocking of the firearm, comprising;

a rotatable and adjustable safety shaft connected to the firing pin lock with locking surfaces, wherein the safety shaft can be set in the bore for the firing pin or abuts a nut at the rear of the firing pin and locks the firing pin, and further wherein the safety shaft is flat in its middle portion and is arrestable in a locking position within the weapon; and a lock bar that tilts around a retaining pin which is located in about the middle of the lock bar.

21. The safety device according to claim 20, wherein the lock bar is pushed with its front side edge towards the safety shaft by force of a spring.

22. The safety device according to claim 20, wherein the spring is a coil spring which is inserted into a dead end bore in the part opposite to the front side edge of the lock bar.

23. The safety device according to according to claim 20, wherein the lock bar is wedge-shaped at least at the part opposite the safety shaft.

24. The safety device according to claim 20, wherein the lock bar is inserted into a slot in the shape of the lock bar alongside the firing pin lock.

25. The safety device according to claim 20, wherein the existing space is made axially within the firearm in front of the safety shaft and partly uncovers the bore for the safety shaft.

26. The safety device according to claim 20, wherein the safety shaft is disposed vertically to the firing pin lock.

* * * * *